United States Patent [19]

Sung et al.

[11] Patent Number: 4,624,682

[45] Date of Patent: Nov. 25, 1986

[54] MOTOR FUEL DETERGENT ADDITIVES

[75] Inventors: Rodney L. Sung, Fishkill; Benjamin J. Kaufman, Hopewell Junction, both of N.Y.

[73] Assignee: Texaco Inc., White Plains, N.Y.

[21] Appl. No.: 845,720

[22] Filed: Mar. 28, 1986

Related U.S. Application Data

[63] Continuation-in-part of Ser. No. 821,713, Jan. 23, 1986.

[51] Int. Cl.[4] ..... C10L 1/22

[52] U.S. Cl. ..... 44/71; 44/74; 44/75

[58] Field of Search ..... 44/74, 75, 71

[56] References Cited

U.S. PATENT DOCUMENTS

| | | | |
|---|---|---|---|
| 4,040,799 | 8/1977 | Oude Alink et al. | 44/75 |
| 4,049,564 | 9/1977 | Ryer et al. | 44/75 |
| 4,385,904 | 5/1983 | Sawicki et al. | 44/56 |
| 4,419,255 | 12/1983 | Kaufman et al. | 252/51.5 A |
| 4,481,013 | 11/1984 | Tack et al. | 44/74 |
| 4,495,077 | 1/1985 | Powell et al. | 252/51.5 A |

*Primary Examiner*—William R. Dixon, Jr.
*Assistant Examiner*—E. M. McAvoy
*Attorney, Agent, or Firm*—Robert A. Kulason; James J. O'Loughlin; Vincent A. Mallare

[57] ABSTRACT

A keto-acid amide derived from the amination of a bicyclic keto-acid with an N-alkyl-alkylene diamine. The keto-acid amides are useful as carburetor detergents for motor fuel compositions.

13 Claims, No Drawings

MOTOR FUEL DETERGENT ADDITIVES

CROSS-REFERENCE

The present application is a continuation-in-part of co-pending U.S patent application, Ser. No. 821,713 filed Jan. 23, 1986.

FIELD OF THE INVENTION

This invention relates to novel amides and to their use as carburetor detergents in motor fuel compositions.

RELATED CASES

The present invention is related to the inventions disclosed in U.S. Pat. Nos. 4,385,904 and 4,419,255 issued to Sawicki et al. These cases are directed to the method of preparation of cyclized keto acids and amides derived from them.

BACKGROUND OF THE INVENTION

As is well known to those skilled in the art, keto-acids and amides may be used as soaps, in various flavor formulations, as chemical or pharmaceutical intermediates and in additive manufacture. Constant attempts are being made to provide new techniques and compositions which may find use in these fields and provide improved products.

It is, therefore, an object of this invention to provide novel compositions which may be useful as carburetor detergents such as keto-acid amides. Other objects will be apparent to those skilled in the art.

SUMMARY OF THE INVENTION

In accordance with certain of its aspects, this invention is directed to a process which comprises aminating a bicyclic keto-acid which was prepared by cyclizing an unsaturated cyclic tetrahydrophthalic dicarboxylic acid anhydride in the presence of a strong Bronsted acid catalyst, with an N-alkyl-alkylene diamine to provide a keto-acid amide. These materials are effective carburetor detergents with a novel structure.

DESCRIPTION OF THE INVENTION

The bicyclic keto-acid amides which may be obtained from the practice of the process of this invention may be those obtained from the amination of bicyclic keto-acids with an N-alkyl-alkylene diamine. The keto-acids may be obtained by the cylcizing (i.e., rearranging) of tetrahydrophthalic acid anhydrides of formula (I)

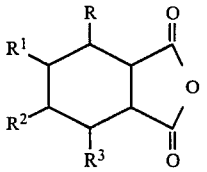

(I)

wherein R, $R^1$, $R^2$, and $R^3$ are H, $CH_3$— or $C_2H_5$—.

Typical of these unsubstituted or alkyl substituted cyclic alken-3-yl-dicarboxylic acid anhydrides are (i) tetrahydrophthalic acid anhydride; (ii) 2,3,4,5,-tetramethyl tetrahydrophthalic acid anhydride; (iii) 2, 3, 4, 5-tetraethyl tetrahydrophthalic acid anhydride; etc.

Bicyclic keto-acid products may be prepared by contacting the cyclic alken-3-yl-dicarboxylic acid anhydride in an inert solvent with a strong Bronsted acid catalyst under anhydrous conditions.

The inert solvents which may be employed in this process include hydrocarbons such as benzene, toluene, xylene, etc; liquid halogenated hydrocarbons typified by methylene dichloride, chloroform, carbon tetrachloride, trichloroethane, etc; liquid nitrohydrocarbons typified by nitrobenzene, nitropropane, nitrobutane; carbon disulfide; etc. The preferred solvent is xylene.

Preferably the inert solvent (vida infra) is present in an amount of about 0.5 to about 10.0 parts per part of anhydride, preferably about 4.0 parts.

The catalyst (vida infra) may be present in the amount of about 0.01 parts to about 1.0 part per part of anhydride, preferably about 0.4 parts.

The reaction may be carried out by contacting the anhydride in an inert solvent with a catalytic amount of acid. Typically, the temperature at which this reaction takes place is about 25° C. to about 160° C., preferably about 60° C. to about 150° C., and more preferably about 140° C.; under atmospheric pressure.

The reaction normally may proceed with agitation over a period of about 1 to about 48 hours, preferably about 1.0 to about 12.0 hours.

After cooling, the reaction mixture is filtered and the solid residue is washed with acetone. Then, the acetone and xylene are combined and stripped under vacuum.

The bicyclic keto-acid derived mixture is prepared from a tetrahydrophthalic acid anhydride material as shown above in formula (I), wherein R, $R^1$, $R^2$, and $R^3$ are each H, $CH_3$— or $C_2H_5$—. Typical keto-acids are illustrated by the structures shown below in FIG. I.

FIG. I

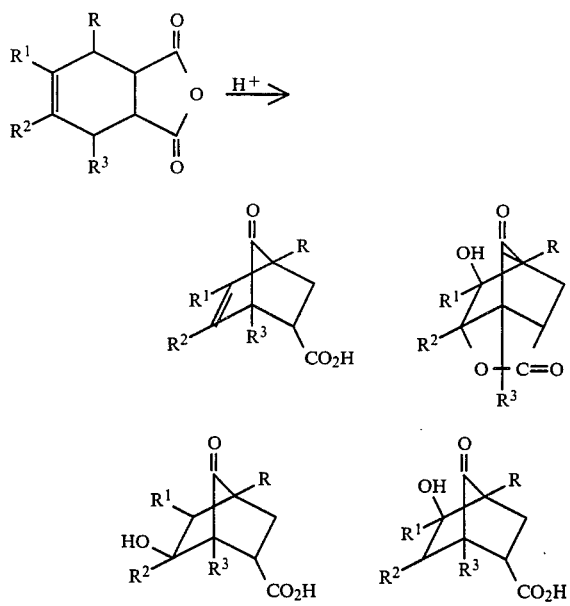

Although it may be possible to effect separation of the several product bicyclic keto-acids as by chromatographic methods (gas or column chromatography), it is found that for many uses this is not necessary. If the product is to be further treated in accordance with this invention, satisfactory results may be attained with no further work-up or pretreating after the removal of the solvent.

In the practice of the present process, the strong Bronsted acid catalysts which may be employed may be characterized by its pKa of less than about −9 and typically about −10 to about −15.

Commercially available strong Bronsted acid which may be employed in the present process include:

(i) $HClO_4$—perchloric acid;

(ii) $CF_3SO_3H$—trifluoromethane sulfonic acid;

(iii) $FSO_3H$—fluorosulfonic acid, and (iv) Nafion—H-501 resin—a perfluorosulfonic acid polymer superacid resin catalyst made by du Pont of Wilmington, Del.

The preferred strong Bronsted acid may be one contained in an organic resin or inorganic support. This allows for easy removal from the reaction mixture as by filtration and easy recycle or regeneration. One such preferred superacid resin catalyst is the Nafion H-501 catalyst, an anhydrous acidic resin stable at temperatures above 100° C. Other suitable catalysts include the well known cross-linked styrene/divinylbenzene copolymers containing sulfonic acid groups which are preferably prepared so as to be highly porous. Such macroporous resins are well-known and may be produced, for example, according to the procedures of U.S. Pat. Nos. 3,418,262; 3,509,078; 3,551,358; 3,637,535 or 3,586,646. The preferred catalyst is the Nafion H-501 resin in its acidic form. The granulated perfluorosulfonic acid polymer has a nominal diameter of 1.0 cm and is formed by copolymerization of tetrafluoroethylene and various monomers such as perfluoro-3,6-dioxa-4-methyl-7-octene sulfonyl fluoride.

The Nafion resin is manufactured and marketed by E. I. du Pont de Nemours and Company of Wilmington, Del.

Prior to use, the resin is treated with a strong acid so as to convert the resin into the acid form. If desired, the acidity of these solid acids can be further increased by complexing with higher valency metal fluorides, such as $SbF_5$, $TaF_5$ or $NbF_3$.

The catalyst as described above, may be present in an amount of about 0.01 to about 1.0 parts, preferably about 0.4 parts per part of acid anhydride. This catalytic amount of acid is found to permit reaction to be readily carried out.

The reaction may be carried out by contacting the charge anhydride in an inert solvent in the presence of the catalytic amount of a strong Bronsted acid catalyst.

Work-up of the reaction mixture may include filtration to remove the strong Bronsted acid resin catalyst (which may be readily reused repeatedly without any regeneration treatment). The solvent may then be stripped off if desired although the reaction mixture may, if desired, be used as is, i.e., product plus solvent. The Nafion resin is further washed with a polar solvent which is combined with the other solvent and stripped under vacuum.

The product keto acid derived reaction mixture may be considered to include the components shown above in Figure I. The structure of the bicyclic material is supported by the various analytical data. Perhaps the most conclusive evidence is obtained using carbon 13 NMR spectroscopy. The technique is quite sensitive to the environment experienced by each carbon atom in the compounds in question. In the above case, the starting material contains no low field resonances below 175 PPM. By contrast, reaction with Nafion H-501 catalyst results in a complex spectra containing a new resonance at 208 PPM. This unique resonance is characteristic of a carbonyl carbon in the 7 position of a bicyclic (2.2.1) system. This data, along with the characteristic carbonyl absorbances in the IR spectrum and mass spectral data constitutes the bulk of our analytical data.

Although it may be possible to effect separation of the product bicyclic keto acids by chromatographic methods (gas br column chromatography), it is found that for many uses this is not necessary. For example, if the product is to be converted to metal salts or to quaternary amine salts for use as dispersants, detergents, friction modifiers, corrosion inhibitors, etc., satisfactory results may be attained with no further work-up or pretreating after preferred removal of the solvent.

While not limiting, the following Example I is illustrative of the present invention.

EXAMPLE I

Cyclization Of Tetrahydrophthalic Anhydride

To a solution of 42.7 parts of tetrahydrophthalic anhydride (Aldrich Chemical Co.) in 170 ml of xylene was added 16 parts of Nafion H-501. The mixture was then heated and stirred at about 140° C. for 1 hour with a slow stream of nitrogen passed through the solution at all times.

After cooling the solution to about 25° C., the mixture was filtered and the residue triturated with acetone. After a second filtration the acetone and xylene solutions were combined and stripped under vacuum. Based upon the analytical data discussed above, the bicyclic products shown in FIG. I were produced and identified.

In practice of the process of this invention, the rearranged keto acid, typically prepared as noted and without separation of the several bicyclic products from each other, may be aminated by reaction with an amine thereby forming an amide reaction product; and recovering said amide reaction product.

The amine which may be employed in the present process include polyamines preferably diamines, which bear at least one primary amine-$NH_2$ group and at least one substituted primary amine group. The latter may be di-substituted but, more preferably, it is mono-substituted. The hydrocarbon nucleus of the amine may be aliphatic or aromatic, including alkyl, alkaryl, aralkyl, aryl or cycloalkyl in nature. The preferred amine may be of the formula:

$$R'—NH—R''—NH_2$$

wherein R′ is a ($C_{12-18}$) hydrocarbon group and R″ is a ($C_1$–$C_3$) hydrocarbon group. In the preferred amines, i.e., monosubstituted primary amines, R′ may be an alkyl, alkaryl, aralkyl, aryl or cycloalkyl hydrocarbon group and R″ may be an alkylene, aralkylene, alkarylene, or arylene hydrocarbon group.

Illustrative of the preferred N-alkyl-alkylene diamines may include those listed in Table I below. These amines are commercially available under the tradename of Duomeens which are manufactured by Akzo Chemie America of Chicago, Ill.

TABLE I

A. The Duomeen O brand of N-oleyl,-1,3-propane diamine.

B. The Duomeen S brand of N-stearyl-1,3-propane diamine.

C. The Duomeen T brand of N-tallow-1,3-propane diamine.

D. The Duomeen C brand of N-coco-1,3-propane diamine.

The most preferred diamine, R'—NH—R''—$NH_2$, is that where the R'' group is trimethylene, —$CH_2CH_2CH_2$— and the R' group is a $C_{12}$–$C_{18}$ N- alkyl group.

Reaction is preferably carried out in an inert atmosphere most preferably under nitrogen. The conditions are shown below in Table II.

TABLE II

| Condition | Broad | Preferred | Typical |
|---|---|---|---|
| Temperature, °C. | 50–250 | 100–150 | 110–128 |
| Pressure, psig | 0–100 | 0–50 | 0 |
| Mole Ratio of —$NH_2$ to —COOH | 0.2–5:1 | 0.5–2:1 | 1:1 |
| Weight Ratio of Diluent to Reactants | 0.2–5:1 | 0.5–4:1 | 3:1 |
| Time, hours | 0.2–30 | 1–25 | 24 |

Illustrative keto-acid amide products, which may be prepared by the process of this invention, are derived from the products shown in FIG. I and may have the structures shown in FIG. II

FIG. II

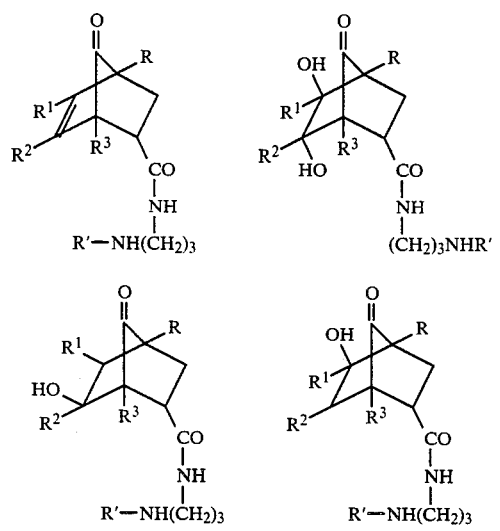

wherein R, $R^1$, $R^2$ and $R^3$ are H, $CH_3$–, or $C_2H_5$–; R' is an oleyl, coco or tallow group; and n is an integer of about 1 to about 3.

The following Examples II, III, IV and V show in detail how the products in FIG. II above, are prepared.

EXAMPLES II–V

Preparation of Reaction Products of Amines and Keto-Acids

In a flask, there was charged 37.4 parts of a crude bicyclioc keto-acid derived from tetrahydrophthalic acid anhydride and 15.2 grams of N-tallow-1,3-propane diamine. The mixture of the keto acid and amine was then stirred and heated under an inert atmosphere for 24 at a temperature of 110°–128° C. The resulting product had an analysis of 5.5% ($N_2$) and a TBN of 110.4.

Results comparable to those of Example II were obtained with the amines and keto-acid reactants listed below in Table III:

TABLE III

| Example | Amine Reactant | Keto-Acid Reactant |
|---|---|---|
| III. | N—oleyl-1,3-propane diamine (1 mole) | The bicyclic keto-acid derived from tetrahydrophthalic acid anhydride (1 mole) |
| IV. | N—stearyl-1,3-propane diamine (1 mole) | The bicyclic keto-acid derived from tetrahydrophthalic acid anhydride (1 mole) |
| V. | N—coco-1,3-propane diamine (1 mole) | The bicyclic keto-acid derived from tetrahydrophthalic acid anhydride (1 mole) |

In accordance with certain of its aspects, the novel amide products of this invention may be used as a carburetor detergent or friction modifier in lubricating oils, as a rust inhibitor in lubricating oils or in motor fuels, etc. The effectiveness of the present amide products is usually determined by the Carburetor Detergency Test described below.

CARBURETOR DETERGENCY TEST

This test measures the cleaning ability of the additive and is run on a Chevrolet V-8 engine mounted on a test stand using a modified four barrel carburetor. The two secondary barrels of the carburetor are sealed; and the feed to each of the primary barrels is arranged so that simultaneously an additive fuel can be run in one barrel and the reference fuel run in the other. The primary carburetor barrels are modified so that they have removable aluminum inserts (sleeves) in the throttle plate area so that deposit formed on the inserts in this area can be conveniently weighed.

A reference fuel, which is an unleaded base fuel plus commercial additive, is charged to one side of the carburetor and the test fuel is charged to the other side. A layer of deposit thus builds up on the inserts over 72 hours. The inserts are removed and weighed.

The engine is run as the feed is admitted to both barrels; engine blow-by is circulated to an inlet in the carburetor body. The test continues for 48 hours.

At the conclusion of the test, the inserts are removed from the carburetor and weighed to determine the difference between the performance of the additive and reference fuels in removing the preformed deposits.

The base fuel employed with the detergent additive of the invention in the following examples was a premium grade gasoline having a Research Octane Number of 99. This gasoline consists of about 23 percent aromatic hydrocarbons, 9 percent olefinic hydrocarbons and 68 percent paraffinic hydrocarbons and boiled in the 90°–375° F. range. The reference fuel contains 60 PTB of a commercial carburetor detergent and corrosion inhibitor in the base fuel.

The compositions of this invention are found to show improved ability to serve in gasolines as a carburetor detergent when measured by the Chevrolet Carburetor Detergency Test (CCDT KC). In the CCDT KC Test, ratings are recorded as differences between a standard commercial additive and the experimental additive.

Products of this invention show equivalent performance to one of the best commercial additive.

In these Examples, the product of Example I is compared to a standard commercial premium fuel detergent additive in a fuel. Specifically in Example I, 20 PTB of the product of instant invention is added to gasoline and tested in the CCDT-KC. In the control example (Example II), 60 PTB of the premium commercial fuel detergent additive is tested in the same test. The results of this comparison and tests are provided below in Table IV.

TABLE IV

| Example | PTB | Additive | Milligrams of Removed Carburetor Deposits |
|---|---|---|---|
| I | 20 | Instant Invention | 2.5 |
| II | 60 | Commercial Additive | 1.7 |

The results indicate that containing 20 PTB of the product of this invention may be about equivalent to about 60 PTB of a fuel containing the commercial additive.

We claim:

1. A motor fuel composition comprising
(a) a major portion of a fuel containing a hydrocarbon boiling in the gasoline boiling range; and
(b) a minor effective amount of, as a detergent additive, an amide reaction product derived from the reaction of an amine and a bicyclic keto-acid.

2. The motor fuel composition of claim 1, wherein said amine is a diamine having the structure:

$$R'—NH—R''—NH_2$$

where R′ is a ($C_{12}$–$C_{18}$) hydrocarbon group and R″ is a ($C_1$–$C_3$) hydrocarbon group.

3. The motor fuel composition of claim 1, wherein said diamine is N-oleyl-1,3-propane diamine.

4. The motor fuel composition of claim 1; wherein said diamine is N-tallow-1,3-propane diamine.

5. The motor fuel composition of claim 1, wherein said diamine is N-stearyl-1,3-propane diamine.

6. The motor fuel composition of claim 1, wherein said diamine is N-coco-1,3-propane diamine.

7. The motor fuel composition of claim 1, wherein said bicyclic keto-acid is derived from a tetrahydrophthalic anhydride.

8. The motor fuel composition of claim 7, wherein said bicyclic keto-acid is derived from 2,3,4,5-tetrahydrophthalic acid anhydride.

9. The motor fuel composition of claim 7, wherein said bicyclic keto-acid is derived from 2,3,4,5-tetramethyl tetrahydrophthalic acid anhydride.

10. The motor fuel composition of claim 1, wherein said reaction is carried out in the presence of an inert diluent.

11. The motor fuel composition of claim 1, wherein said reaction is carried out in a hydrocarbon diluent.

12. The motor fuel composition of claim 1, wherein the additive is the product of the reaction of
(a) N-tallow-1,3-propane diamine in an inert hydrocarbon at 110° C.–130° C., and
(b) a bicyclic keto-acid derived from the super-acid catalyzed rearrangement of tetrahydrophthalic acid anhydride in the presence of a super Bronsted acid catalyst.

13. A motor fuel composition comprising:
(a) a major portion of a fuel containing a hydrocarbon boiling in the gasoline boiling range; and
(b) a minor effective amount of, as a detergent additive, a product derived from the reaction of
(i) an N-alkyl-alkylene diamine, and
(ii) a bicyclic keto-acid derived from a catalyzed rearrangement of a ($C_{6-10}$)cyclic alken-3-yl carboxylic acid anhydride in the presence of a super Bronsted acid catalyst.

* * * * *